US011236646B2

(12) United States Patent
Altherr et al.

(10) Patent No.: US 11,236,646 B2
(45) Date of Patent: Feb. 1, 2022

(54) VALVE DRIVE DEVICE WITH SWITCHOVER DEVICE

(71) Applicant: Mahle International GmbH, Stuttgart (DE)

(72) Inventors: Patrick Altherr, Stuttgart (DE); Thorsten Ihne, Stuttgart (DE); Markus Lindgren, Benningen (DE)

(73) Assignee: Mahle International GmbH

( * ) Notice: Subject to any disclaimer, the term of this patent is extended or adjusted under 35 U.S.C. 154(b) by 0 days.

(21) Appl. No.: 17/251,781

(22) PCT Filed: May 8, 2019

(86) PCT No.: PCT/EP2019/061766
§ 371 (c)(1),
(2) Date: Dec. 12, 2020

(87) PCT Pub. No.: WO2019/238316
PCT Pub. Date: Dec. 19, 2019

(65) Prior Publication Data

US 2021/0254516 A1 Aug. 19, 2021

(30) Foreign Application Priority Data

Jun. 13, 2018 (DE) ..... 102018209397.0

(51) Int. Cl.
*F01L 9/04* (2006.01)
*F01L 9/21* (2021.01)
*F01L 1/18* (2006.01)

(52) U.S. Cl.
CPC ..... *F01L 9/21* (2021.01); *F01L 1/18* (2013.01); *F01L 2009/2105* (2021.01); *F01L 2009/2134* (2021.01); *F01L 2820/031* (2013.01)

(58) Field of Classification Search
CPC ..... F01L 9/21; F01L 1/18; F01L 2009/2105; F01L 2009/2134; F01L 2820/031;
(Continued)

(56) References Cited

U.S. PATENT DOCUMENTS 5,752,482 A 5/1998 Roettgen et al.
8,251,028 B2 8/2012 Ezaki et al.
(Continued)

FOREIGN PATENT DOCUMENTS

CN 101802351 A 8/2010
CN 103696821 A 4/2014
(Continued)

OTHER PUBLICATIONS

English abstract for DE-3923487.
(Continued)

*Primary Examiner* — Zelalem Eshete
(74) *Attorney, Agent, or Firm* — Fishman Stewart PLLC

(57) ABSTRACT

A valve drive device for actuating valves of an internal combustion engine a rocker arm device and a switchover device that includes at least two actuators for the at least one rocker arm device. The two actuators respectively include a switching element adjustable between a first position and a second position; a resetting device for resetting the switching element with a resetting force into the second position; a holding coil for offsetting the resetting force of the resetting device; a switching coil that counteracts the resetting force during operation. The switching coil and the holding coil adjust the switching element into the first position.

20 Claims, 5 Drawing Sheets

(58) Field of Classification Search
CPC ..... F01L 13/0036; F01L 1/181; F01L 1/26; F01L 2800/00; F01L 2013/101
See application file for complete search history.

(56) References Cited

U.S. PATENT DOCUMENTS

| | | | | |
|---|---|---|---|---|
| 8,810,083 | B2 | 8/2014 | Kirstein | |
| 10,247,063 | B2 | 4/2019 | Altherr et al. | |
| 10,287,929 | B2 | 5/2019 | Pham | |
| 10,641,142 | B2 | 5/2020 | Altherr | |
| 2014/0102389 | A1* | 4/2014 | Stolk ..... | F01L 13/0036 123/90.15 |
| 2017/0114676 | A1 | 4/2017 | Verner et al. | |
| 2017/0362970 | A1 | 12/2017 | Niekamp et al. | |
| 2020/0032681 | A1 | 1/2020 | Burssner et al. | |

FOREIGN PATENT DOCUMENTS

| | | | |
|---|---|---|---|
| CN | 107288696 | A | 10/2017 |
| DE | 3923487 | A1 | 1/1991 |
| DE | 19610468 | A1 | 2/1997 |
| DE | 19813797 | A1 | 10/1998 |
| DE | 102011103169 | A1 | 12/2012 |
| DE | 102015005369 | A1 | 10/2016 |
| DE | 102015215123 | A1 | 2/2017 |
| DE | 102016210978 | A1 | 12/2017 |
| DE | 102016210979 | A1 | 12/2017 |
| DE | 102016118254 | A1 | 3/2018 |
| EP | 0179990 | A2 | 5/1986 |

OTHER PUBLICATIONS

English abstract for DE-102016210978.
English abstract for DE-19610468.
English abstract for DE-102015005369.
Chinese Search Report for CN-201980034606.8, dated Oct. 27, 2021.
English abstract for CN-103696821.

* cited by examiner

| | | S | H |
|---|---|---|---|
| 0 | 0 | 0 | 0 |
| 0 | 1 | 0 | 1 |
| 1 | 0 | 1 | 1 |
| 1 | 1 | 1 | 1 |

VALVE DRIVE DEVICE WITH SWITCHOVER DEVICE

CROSS-REFERENCE TO RELATED APPLICATIONS

This application claims priority to International Patent Application No. PCT/EP2019/061766 filed May 8, 2019, which also claims priority to German Patent Application DE 10 2018 209 397.0 filed Jun. 13, 2018, the contents of each of which is hereby incorporated by reference in its entirety.

TECHNICAL FIELD

The present invention relates to a valve drive device for actuating valves of an internal combustion engine, which for this purpose comprises rocker arm devices, which interact with a camshaft of the valve drive device. The invention, furthermore, relates to a switchover device of the valve drive device for switching over the rocker arm devices and to a method for controlling the switchover device.

BACKGROUND

For actuating valves of an internal combustion engine, which can be configured as inlet valves and exhaust valves, generic valve drive devices comprise rocker arm devices which in each case comprise a valve lever, with which at least one valve of the internal combustion engine is actuated. The respective rocker arm device in the process interacts with a camshaft of the valve drive device. It is conceivable providing the respective rocker arm device with a cam follower, which interacts with a cam body of the camshaft, in order to actuate the associated rocker arm and thus the associated valve. It is additionally conceivable to optionally couple and decouple the cam follower and the rocker arm in order to make possible an improved and/or more variable operation of the internal combustion engine. For this purpose it is desirable to switch the respective rocker arm device between corresponding switching states. For this purpose, a switchover device can basically be employed.

Such switchover devices are usually hydraulically operated so that they require an increased design effort.

In principle it is also conceivable to provide the switchover device with actuators, which can be electromagnetically operated. This requires the use of corresponding electronics, in particular control units, which in turn have an elaborate construction of the valve device as a consequence.

The present invention therefore deals with the object of stating improved or at least alternative embodiments for a valve drive device of the type mentioned above and for a switchover device of such a valve drive device and for a method for controlling such a switchover device, which are characterized in particular by a simplified and/or cost-effective construction.

According to the invention, this object is solved through the subjects of the independent claims. Advantageous embodiments are subject of the dependent claims.

SUMMARY

The present invention is based on the general idea of providing a switchover device of a valve drive device for switching over at least one rocker arm device between a first position and a second position of the valve drive device with actuators, which comprise magnetic switching elements which are adjusted with the help of coils, wherein these coils are controlled by a control unit of the switchover device. Here, the control unit comprises for a first type of coils a common output and for a second type of the coils an associated output each. The adjusting of the switching element by means of the coils allows a simplified and precise switching over of the at least one rocker arm device. The common output of the coils of the first type additionally leads to a substantial simplification of the control unit, in particular to a substantial reduction of the outputs on the control unit, so that the valve drive device can be constructed in a simplified manner and/or realised more cost-effectively. According to the inventive idea, the valve drive device comprises at least one rocker arm device, wherein the respective rocker arm device interacts with a camshaft of the valve drive device in order to actuate during the operation at least one valve of an associated internal combustion engine. For switching over the at least one rocker arm device between the first position and the second position, the switchover device comprises at least two actuators. The respective actuator comprises a switching element for switching over the at least one rocker arm device, which is adjustable between a first position and a second position. The respective actuator additionally comprises a resetting means for resetting or adjusting the switching element with a resetting force into the second position. Additionally, the respective actuator comprises a holding coil and a switching coil. The holding coil serves for offsetting the resetting force of the resetting means. This means that the holding coil during the operation offsets the resetting force of the resetting means in such a manner that the switching element during the operation of the holding coil is held in position. The switching coil serves for adjusting the switching element into the first position, wherein the switching coil during the operation counteracts the resetting force of the resetting means and together with the holding coil adjusts the switching element into the first position. The coils of the actuators are controlled with the help of the control unit of the switchover device, wherein the control unit for the respective switching coil comprises an associated switching coil output. By way of the respective switching coil output of the control unit, an associated switching coil is thus controlled, in particular energized, so that the switching coils can be activated, in particular energized individually or independently of one another. For at least two of the holding coils, the control unit additionally comprises a common holding coil output so that these holding coils for the common holding coil output can be jointly controlled, in particular energized. By way of this, the number of the required holding coil outputs is substantially reduced, wherein the actuators are nevertheless individually adjustable. This is particularly advantageous since the outputs on a control unit are generally limited or have to be reduced. Preferably, a single holding coil output for all holding coils is provided on the control unit. This leads to a further simplification of the construction of the control unit and thus of the switchover device and the valve drive device.

The valve drive device preferentially comprises at least two such rocker arm devices, wherein the respective rocker arm device is assigned such an actuator. This means that for the respective rocker arm device an associated actuator is provided, which adjusts the associated rocker arm device between the first and second position.

Preferably, all coils of the actuators, i.e. all holding coils and all switching coils, are jointly supplied electrically. In particular, all coils can be electrically contacted with a common electrical phase, for example a positive phase. Here, electric current flows are indicated in the technical sense, i.e. from the positive phase to the negative phase. Here, the energizing of the coils is effected via the control unit and thus via the switching coil outputs and the holding coil output of the control unit. For this purpose, the control unit can emit for example pulse width-modulated signals. Also conceivable are switching bridges, for example half bridges or full bridges.

Practically, the switching element is configured in such a manner that the magnetic fields generated with the coils act on the same and correspondingly adjust the same. To this end, the switching element can be at least partially magnetic or fixed on a magnet.

The control unit can be a part of the valve drive device. The control unit can be a common control unit of an associated system which, besides the valve drive device, also comprises the internal combustion engine. Thus, the control unit can be equipped for the joint control of the valve drive device and of the internal combustion engine, in particular as engine control unit.

The respective rocker arm device practically comprises at least one valve lever, with which the associated valve is actuated. With the switchover device, a switching over of the rocker arm device advantageously takes place between the first and the second position in such a manner that the rocker arm device actuates the associated valve or does not actuate the associated valve. It is also conceivable to realise with the switchover device a switching over of the rocker arm device in such a manner that the valve is coupled to different cam followers and/or cam bodies so that a different actuation of the valve takes place. Accordingly, an interaction of the switching element with the rocker arm device can take place in the first position of the associated switching element in such a manner that a corresponding switching of the rocker arm device takes place. The second switching position can be a neutral position of the switching element in which no interaction of the switching element with the rocker arm device takes place. Embodiments, in which in the second position of the switching element a different switching of the rocker arm device takes place are also conceivable. Preferably, the interaction of the switching element with the rocker arm device is mechanical. In particular, the rocker arm device can comprise at least one pin which interacts with the switching element for switching over the rocker arm device, in particular strikes against the switching element.

The holding coil of the respective actuator serves, as mentioned above, for the purpose of holding the switching element of the holding coil in position during the operation. Accordingly, the force acting from the holding coil on the switching element during the operation counteracts the resetting force of the resetting means, in particular offsets the same. Practically, the switching coil also counteracts the resetting force of the resetting means, wherein the switching coil during the operation, i.e. during the energization, together with the holding coil, has as a consequence the adjusting of the associated switching element into the first position. To this end, the force acting from the switching coil on the switching element during the operation is preferentially at least as large as the resetting force, preferentially greater than the resetting force.

Basically, the switching element can be configured in any way. It is conceivable to configure the switching element as a switching rod which is linearly or translationally adjusted between the first position and the second position.

Preferred versions provide that the resetting means is a mechanically acting one. By way of this, the switchover device and thus the valve drive device can be realised in a simple and cost-effective manner.

In preferred embodiments, at least one of the resetting means, particularly preferably the respective resetting means, is a spring which acts on the switching rod. For this purpose, an anchor and the like can be attached to the switching rod.

Preferred are embodiments, in which with at least one of the actuators an electrical line between the switching coil and the holding coil is provided. In the line, a diode is arranged in such a manner that when the switching coil is energized, it allows an energization of the holding coil via the line and blocks a reverse energization, i.e. an energization of the switching coil via the line when the holding coil is energized. For this purpose, the diode blocks the electric current, dependent on the electrical contacting of the holding coil and the switching coil with electric phases, in a direction and allows the electric current through in the opposite direction. As a consequence, the holding coil during the energizing of the switching coil is likewise energized, so that the holding coil is also selectively energizable via the associated switching coil. In particular when the holding coil is also energized via the main coil output, a support of the switching coil additionally takes place in such a manner that an amplified resultant force acts against the resetting force. By way of this an, in particular faster, adjusting of the switching element between the second position and the first position and/or vice versa can take place.

The respective line and the associated diode additionally allow an energization of the associated holding coil in the manner of a logical OR-operation such that the respective holding coil is energized in particular when the energization takes place via the main coil output or when the associated switching coil is energized.

Embodiments, in which the line runs between the inputs of the respective coil prove to be advantageous here. This means in particular that the diode is located outside the coils.

In advantageous versions a diode is arranged between at least one of the holding coils and the holding coil output of the control unit, preferably between the respective holding coil and the holding coil output in such a manner that upon energization of the holding coil an energization of the holding coil output via the holding coil is blocked. Thus, in particular a mutual influencing or interfering of the holding coils is prevented or at least reduced. In particular, the influence of the holding coil on other holding coils is prevented or at least limited when the holding coil is energized via the abovementioned line, when the associated holding coil is energized. This arrangement of the respective diode can be realised in that the respective holding coil is electrically contacted with an electrical line, referred to as sub-branch in the following, wherein the respective sub-branch, via an associated node, for example a terminal, merges into a main branch, which is electrically conductive and electrically connected to the main coil output. Here, the diode of the respective holding coil, in the following also referred to as sub-branch diode, is suitably arranged in the associated sub-branch.

Practically, the respective rocker arm device and thus the associated actuator is assigned to a cylinder of the internal combustion engine.

Obviously, at least two valves of the internal combustion engine can also be actuated with the respective rocker arm device.

Advantageously, the actuating of the valves and thus the switching over of the rocker arm devices is matched to the given firing order of the cylinders here. Accordingly, the switching elements are sequentially adjusted into the first position and/or into the second position.

The sequential adjusting of the switching elements into the respective first position preferentially takes place in such a manner that the holding coils are energized via the common holding coil output of the control unit, whereas the switching coils are energized offset in time corresponding to the desired sequence. The energization of the switching coils offset in time leads to the adjusting of the respective associated switching element into the first position, so that the switching elements are adjusted into the first position offset in time corresponding to the desired sequence. Thus, despite the reduced number of holding coil outputs, a simple and sequential adjusting of the switching elements into the first position is nevertheless possible.

The sequential adjusting of the switching elements into the second position advantageously takes place in that the energization of the holding coils is discontinued, i.e. aborted. Compared with this, the energization of the switching coils is discontinued offset in time according to the desired sequence. Following the discontinuing of the energization of the holding coils the respective switching element is thus held in position by the associated switching coil until the associated switching coil is no longer energized or no longer adequately energized, so that the resetting force of the resetting means adjusts the switching element into the second position.

This makes possible, despite the reduced number of holding coil outputs, a simple and sequential adjusting of the switching elements into the second position.

Alternatively, the sequential adjusting of the switching elements into the second position can take place in such a manner that the holding coils are energized at time intervals and the energization of the switching coils is discontinued offset in time according to the desired sequence, wherein the energization of the energized switching coils in the energization phases of the holding coils is interrupted. This means that for switching elements, which are not to be adjusted into the second position yet, an energization of the holding coil and the switching coil alternately takes place in order to hold the switching element in position, in particular in the first position. By way of this, the total energization duration of the switching coils and the holding coils is reduced so that these are subjected to less load. By way of this, the lifespan of the coils can be extended in particular.

Preferred are embodiments, in which the discontinuing of the energization of the respective switching coil takes place in an energization-free phase of the holding coil. This simplifies the adjusting of the switching element into the second position.

Advantageously, the energization of the holding coils takes place periodically in the time intervals. This allows a simplified controlling of the coils.

It is to be understood that besides the valve drive device the switchover device as such is also included in the scope of this invention. It should likewise be understood that a method for controlling such a switchover device, with which the holding coils are jointly energized by at least two of the actuators via a common holding coil output of the control unit and the switching coils each via associated switching coil outputs of the control unit, is part of the scope of this invention.

Further important features and advantages of the invention obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
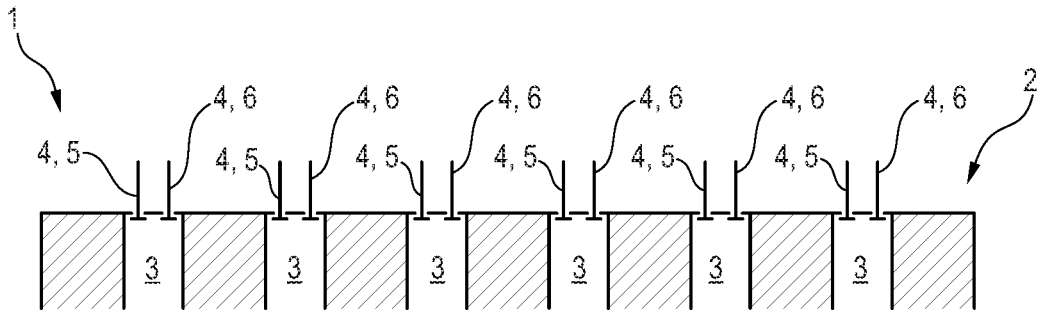
FIG. 1 a greatly simplified representation of an internal combustion engine system with an internal combustion engine, FIG. 2 an isometric view of a valve drive device of the internal combustion engine system with a camshaft and a rocker arm device, FIG. 3 a longitudinal section through an actuator of a switchover device in a first position, FIG. 4 the view from FIG. 3 in a second position of the actuator, FIG. 5 a circuit diagram-like representation of the switchover device, FIG. 6 a switching logic of the switchover device, FIG. 7 a switching logic with another exemplary embodiment, FIG. 8 a circuit diagram-like representation of the switchover device with another exemplary embodiment, FIG. 9 a switching logic for switching the switchover device from FIG. 8, FIG. 10 the switching logic for switching the switchover device from FIG. 8 with another exemplary embodiment, FIG. 11 a truth table.

An internal combustion engine system 1 comprises an internal combustion engine 2 as it is shown in FIG. 1. The internal combustion engine 2 comprises at least one, preferentially multiple, cylinders 3, wherein the shown internal combustion engine 2 purely exemplarily comprises six such cylinders 3. In the respective cylinder 3, a piston which is not shown is stroke-adjustably received. The respective cylinder 3 is assigned at least one valve 4, preferentially two valves 4, wherein in FIG. 1 the respective cylinder 3 is purely exemplarily assigned two valves 4, namely an inlet valve 5 for letting in air or a fuel-air mixture into the cylinder 3 and an exhaust valve 6 for letting out exhaust from the cylinder 3.

Figure 2:
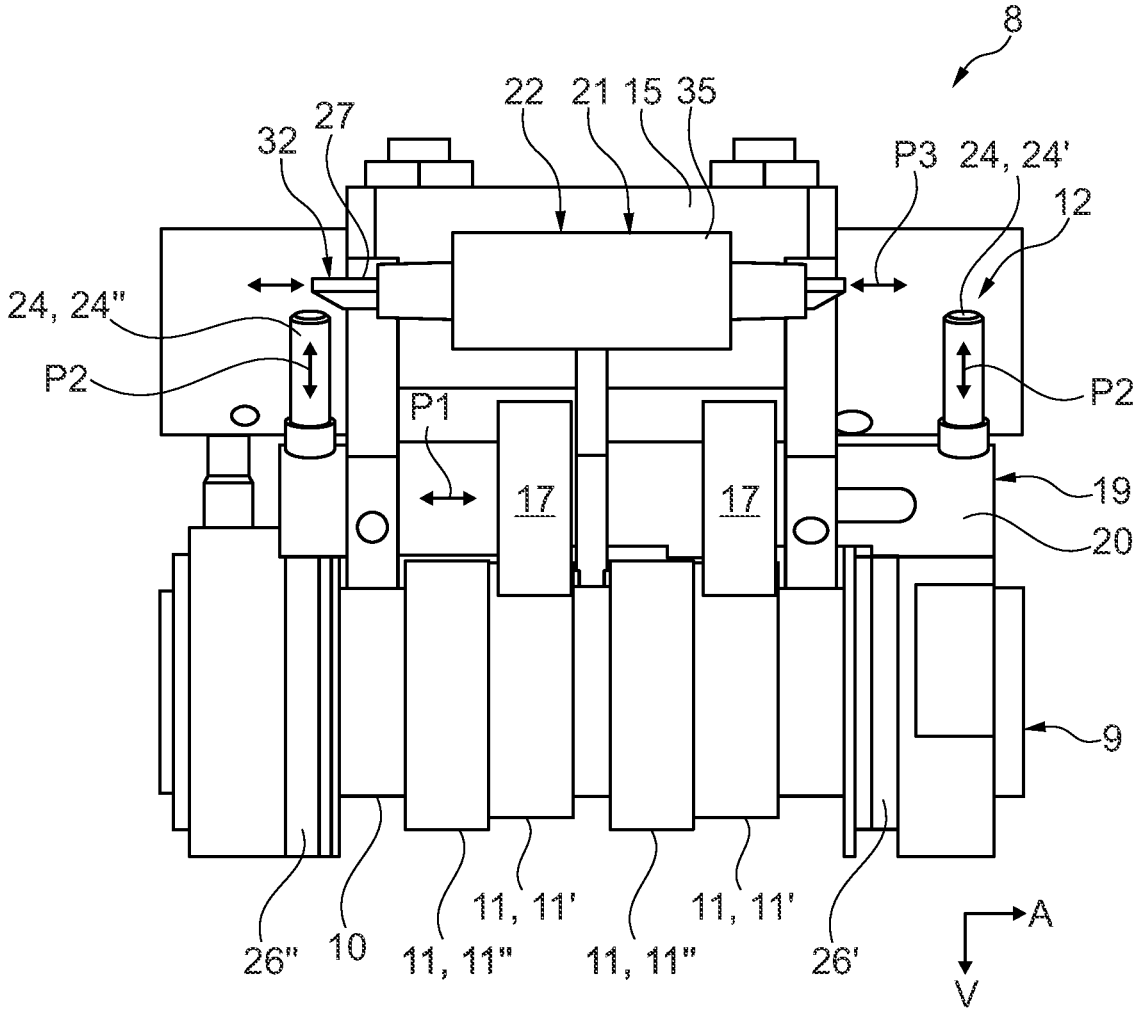

For actuating the valves 4, the internal combustion engine system 1 comprises a valve drive device 8, such as is shown for example in FIG. 2. The valve drive device 8 comprises a camshaft 9 comprising multiple cam bodies 11. In the shown example, two first cam bodies 11' and axially adjacently two second cam bodies 11" are arranged on a shaft body 10 of the camshaft 9 in a rotationally fixed manner. Furthermore, the valve drive device 1 comprises at least one rocker arm device 12, wherein in FIG. 2 a single rocker arm device 12 is shown, which is preferentially assigned to one of the cylinders 3 of the internal combustion engine 2. The rocker arm device 12 comprises a cam follower 19, which in the shown example comprises a bolt body 20. The cam follower 19 additionally comprises two rotatable track rollers 17. The cam follower 19 is attached to a rocker or cam lever 15, by means of which valves 4 of the internal combustion engine 2 can be activated. The two track rollers 17 and the bolt body 20 are adjustable relative to the cam lever 15 along an axial direction A between a first position and a second position (see arrow P1). The expressions "axial" and "along the axial direction A" are used equivalently in the present context. In the first position shown in FIG. 1, the two track rollers 17 of the cam follower 19 are drive-connected to the first cam bodies 11'. In the second position, the two track rollers 17 of the cam follower 19 are drive-connected to the second cam bodies 11". In the versions of the example, a different number of first and second cam bodies 11', 11" can also be provided. In a simplified version, only exactly one first cam body 11' and exactly one second cam body 11" each can be provided.

The rocker arm device 12, furthermore, comprises at least one adjustable pin 24. The shown rocker arm device 12 comprises an adjustable first pin 24', which for axially adjusting the cam follower 19 from the first into the second position interacts with a first slotted guide 26' provided on the camshaft 9. Likewise, the rocker arm device 12 comprises an adjustable second pin 24", which for adjusting the cam follower 19 from the second into the first position interacts with a second slotted guide 26" provided on the camshaft 9.

The two pins 24', 24" are arranged on the bolt body 20 of the cam follower 19. Both the first pin 24' and also the second pin 24" are each adjustable between an active position, in which the pin 24', 24" interacts with the associated slotted guide 26', 26", and an inactive position, in which this interaction is cancelled. In the example scenario, the two pins 24', 24" are adjustable for this purpose along an adjusting direction V perpendicularly to the axial direction A (see arrow P2). In the switching position, the respective pin 24', 24" engages in the associated slotted guide 26', 26". In the inactive position, the respective pin 24', 24" is arranged spaced apart from the associated slotted guide 26', 26". The respective pin 24', 24" is adjusted with a switchover device 21 from the inactive position into the active position, which thus adjusts the rocker arm device 12 from the first position into the second position and/or vice versa.

The switchover device 21 comprises at least two actuators 22, wherein with the at least two actuators 22 a switching over of at least one rocker arm device 12 takes place. Preferentially, the respective cylinder 3 of the internal combustion engine 2 or the rocker arm device 12 of the respective cylinder 3 is assigned an actuator 22 each. Particularly preferably, the respective valve 4 of the internal combustion engine 2 is assigned a rocker arm device 12 and an actuator 22 for switching the rocker arm device 12, wherein the first cam bodies 11' and the second cam bodies 11" are designed differently, in particular having different profiles, so that the respective valve 4 in the first position and in the second position of the associated rocker arm device 12 is actuated differently.

Figure 3:
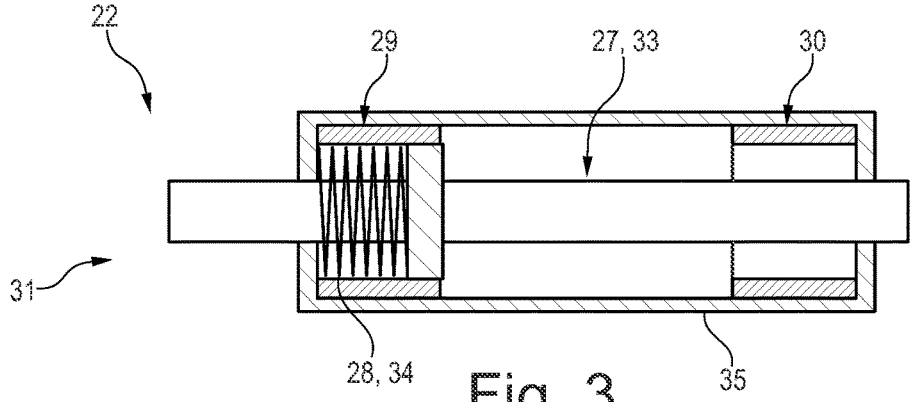
Figure 4:
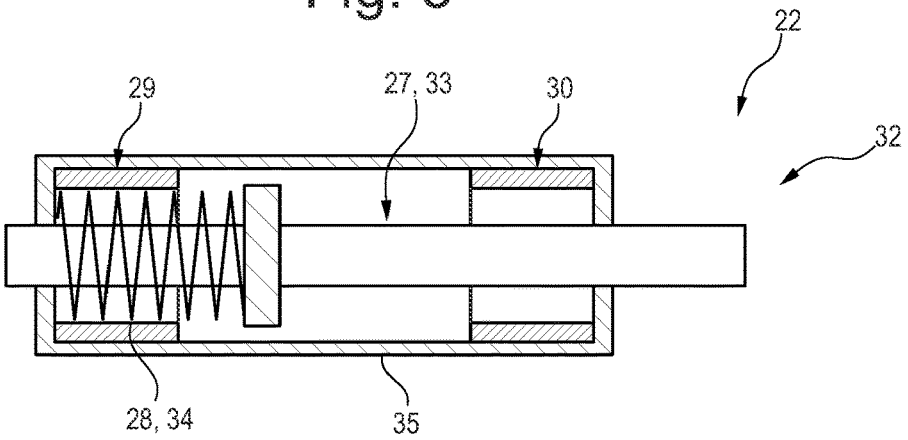

The FIGS. 3 and 4 each show a section through one of the actuators 22, wherein the actuators 22 are preferentially formed identically. The respective actuator 22 comprises a magnetic switching valve 27, which for switching over the associated rocker arm device 12 interacts with at least one of the pins 24. In the example of FIG. 2, the shown switching element 27 interacts with both pins 24', 24". The actuator 22 additionally comprises a resetting means 28, a holding coil 29 and a switching coil 30. The switching element 27 is axially adjustable between a first position 31 shown in FIG. 3 and a second position 32 shown in FIG. 4. Here, the switching element 27 can interact in the first position 31 with one of the pins 24 and in the second position 32 with one other one of the pins 24, wherein this interaction consists of a striking of the pin 24 against the switching element 27, so that the pin 24 is adjusted into the active position and interacts with the associated slotted guide 26', 26". In the example shown in FIG. 2, the switching element 27 interacts in the shown second position 32 with the second pin 24" and in the first position 31 with the first pin 24'. In a version, the switching element 27 merely interacts with an associated pin 24 in the first position 31 and in the second position 32 is situated in a neutral position, in which no interaction and thus no switching over of the rocker arm device 12 takes place. In the shown example, the switching element 27 is formed as a cylindrical switching rod 33, which is linearly or translationally adjustable between the first position 31 and the second position 32. The resetting element 28, which here is formed as a spring 34, acts with a resetting force on the switching element 27 in such a manner that the resetting means 28 adjusts the switching element 27 with the resetting force into the second position 32. With the holding coil 29, an offsetting of the resetting force of the resetting means 28 takes place during the operation, i.e. when the holding coil 29 is energized, in such a manner that the switching element 27 is held in position. Thus, the holding coil 29 counteracts the resetting force. With the switching coil 30, the switching element 27 is adjusted into the first position 31. Thus, the switching coil 30 acts, during the operation, i.e. during energization, on the switching element 27 in particular jointly with the holding coil 29, and overcomes the resetting force of the resetting element 28 in order to adjust the switching element 27 into the first position 31. When the coils 29, 30 are not energized or the energization falls below a predetermined value in such a manner that the magnetic total force acting from the coils 29, 30 on the magnetic switching element 27 is smaller than the resetting force of the resetting element 27, the switching element 27 is thus adjusted into the second position 32.

In the shown examples, the actuator 22 comprises a can-like cylindrical body 35, through which the switching element 27 is adjustably guided, wherein the switching element 27 in the first position 31 and the second position 32 protrudes from opposite sides of the cylindrical body 35 by a different distance. The resetting element 28 and the coils 29, 30 are arranged within the cylindrical body 35. The resetting element 28 lies on the inside against the cylindrical body 35 and an anchor 36 fixed on the switching element formed in one piece with the same, in order to act on the switching element 27 with the resetting force. The coils 29, 30 are spaced apart from one another along the switching element 27 and arranged on the end side of the cylindrical body 35, wherein they surround the switching element 27.

Figure 5:
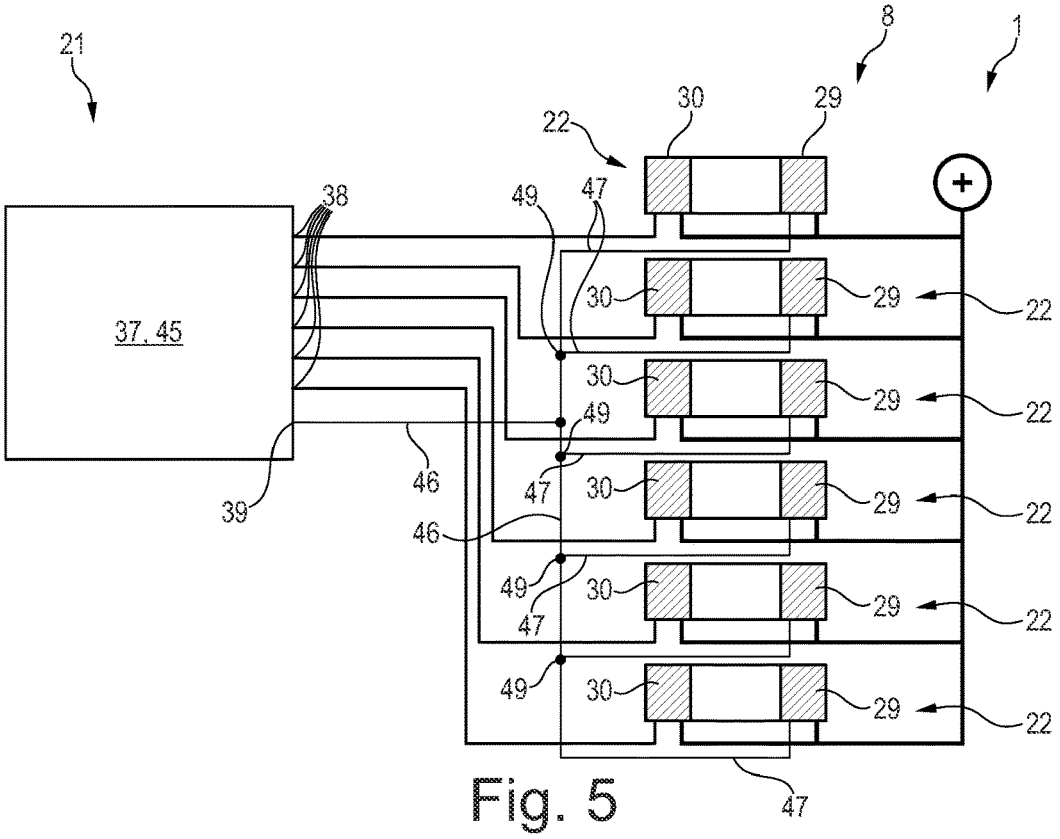

According to FIG. 5, all coils 29, 30 are electrically supplied with a common supply voltage. In the shown example, this is effected by connecting all coils 29, 30 to an electrically positive phase. Here, the current directions are indicated in the technical sense, so that the electrical current directions correspond to the technical current direction. Besides the actuators 22, which in FIG. 5 are merely shown with their respective holding coil 29 and switching coil 30, the switchover device 21 comprises a control unit 37 for controlling the coils 29, 30 of the actuators 22. The control unit 37 can also be employed for controlling other parts of the internal combustion engine system 1, in particular be an engine control unit. With the control unit 37, an activation of the coils 29, 30 takes place in such a manner that the same are energized. To this end, the control unit 37 can emit for example pulse width-modulated signals.

For the respective switching coil 30, the control unit 37 comprises an associated switching coil output 38 with which the switching coils 30 can each be activated independently of one another or individually. In the shown example, an associated actuator 22 is provided for the respective cylinder 3. Thus, a total of six actuators 22 are provided for the internal combustion engine 2 with the six cylinders 3 shown in FIG. 1, each of which actuators comprises a switching coil 30. Accordingly, six switching coil outputs 38 are provided on the control unit 37, each of which is electrically contacted with one of the switching coils 30. Compared with this, the control unit 37 merely comprises a holding coil output 39, with which all of the holding coils 29 of these actuators 22 are jointly activated. Accordingly, the holding coil output 39 is simultaneously contacted electrically with all holding coils 29.

Figure 6:
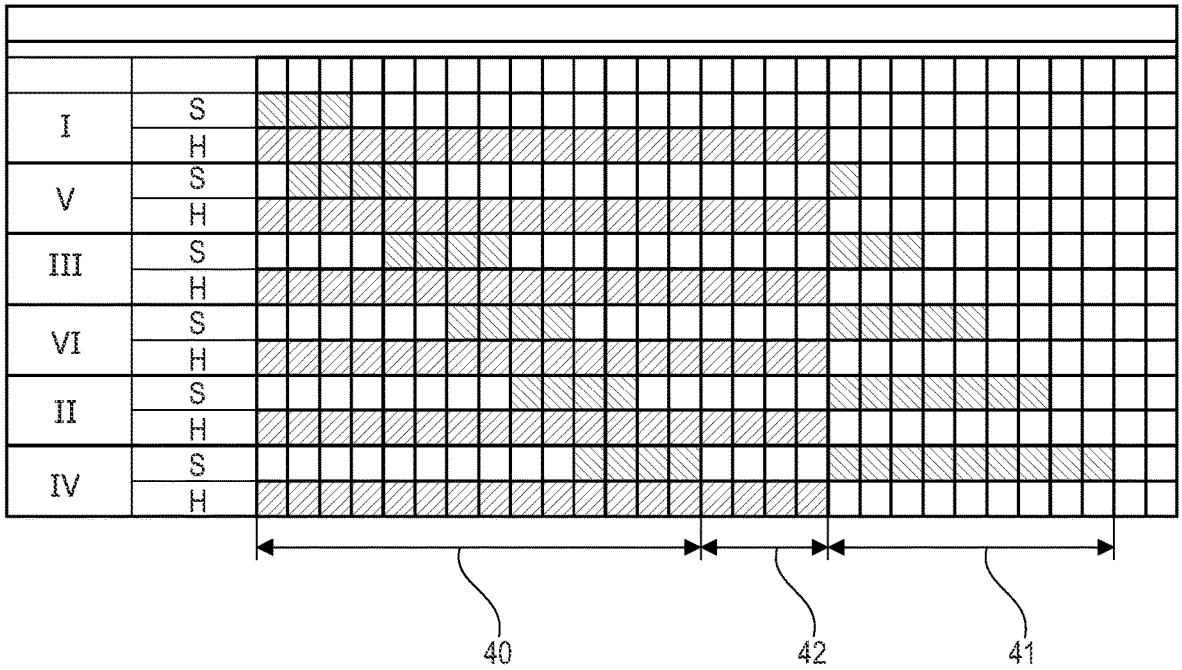
Figure 7:
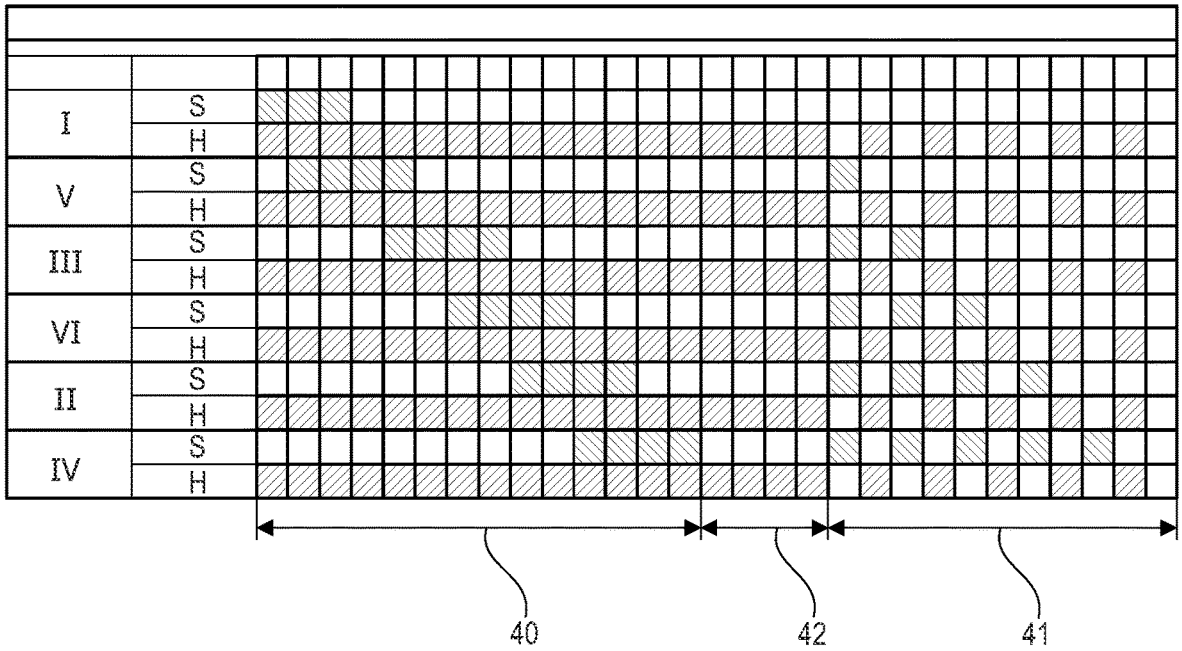

The control unit controls the actuators 22 and thus the coils 29, 30 according to the switching logic shown in FIG. 6 or in FIG. 7, wherein the control unit 37 is suitably configured for this purpose.

In the FIGS. 6 and 7, an enumeration of the total of six cylinders 3 is indicated by Roman figures in the first column. The respective cylinder 3 is, as described above, assigned an actuator 22 and thus a switching coil 30 and a holding coil 29, wherein in the second column of the switching logic for the respective cylinder 3 the associated switching coil 30 is symbolised by the letter "S" and the associated holding coil 29 by the letter "H". The following columns of the switching logic indicate a time sequence, wherein the columns each include a same unit of time. When the relevant field in the column for the respective switching coil 30, indicated by the letter "S", is shown filled or hatched, this means that the switching coil 30 is energized in the given unit of time. The same applies to the fields which are assigned to the holding coils 29, in each case symbolised by the letter "H". Blank fields by contrast mean that no energization of the relevant coil 29, 30 takes place.

Accordingly, the switching elements 27 of all actuators 22 are adjusted according to FIG. 6, in a first switching phase 40, into the respective first position 31. Since there is a firing order in the internal combustion engine 2, the actuators 22 are adjusted sequentially, i.e. offset in time corresponding to this firing order. For this purpose, a control signal is output from the holding coil output 39 so that all holding coils 29 are energized. This is shown by the hatched fields of all holding coils 29 in the entire first switching phase 40. Compared with this, the switching coils 30 are activated offset in time and thus energized. In the example of the first cylinder 3, symbolised by I, an energization of the switching coil 30 thus takes place, wherein the switching coil 30 and the holding coil 29 each generate a magnetic field, which jointly overcome the resetting force of the resetting element 28 in such a manner that the associated switching element 27 is adjusted into the first position 31. On reaching the first position 31, the activation and thus the energization of the switching coil 30 of the associated actuator 22 is discontinued, so that the following fields are blank or unhatched. The energization of the holding coil 29 results in that the switching element 27 of this actuator 22 remains in the first position 31. Analogously to this, the switching coils 30 of the other actuators 22 are energized offset in time in order to adjust the respective associated switching element 27 offset in time and thus sequentially into the first position 31. In FIG. 6 it is assumed here that initially the switching element 27 belonging to the first cylinder is adjusted into the first position 31. This is followed by the switching element 27 assigned to the fifth cylinder 3, followed by the switching element 27 assigned to the third cylinder 3, the sixth cylinder 3, the second cylinder 3 and the fourth cylinder 3. Upon conclusion of the first switching phase 40, all switching elements 27 of all actuators 22 are thus situated in the first position 31.

For sequentially adjusting the switching elements 27 into the respective associated second position 32 according to the firing order of the cylinders 3, the actuators 22 and thus the associated coils 29, 30 are activated in a second switching phase 41. In the second switching phase 41, the activation or energization of the holding coils 29 is discontinued. In addition, the activation and thus energization of the switching coils 30 corresponding to the desired sequence is discontinued offset in time or the switching coils 30 are energized for different periods according to the desired sequence. Here, the magnetic field generated by the respective switching coil 40 counteracts the resetting force of the resetting element 28 and is at least as great as the resetting force, so that the associated switching element 27 is at least held in position. When the activation of the respective switching coil 30 is discontinued, the resetting force of the resetting element 28 adjusts the associated switching element 27 into the second position 32. In the shown example, an intermediate phase 42 is provided between the first switching phase 40 and the second switching phase 41, in which none of the switching coils 30, however all holding coils 29 are activated and thus energized, in order to hold the respective associated switching element 27 in the first position 31.

FIG. 7 shows an alternative switching logic for controlling the switchover device 21 from FIG. 5. In this exemplary embodiment, the first switching phase 40 and the intermediate phase 42 correspond to the example shown in FIG. 6. The sequential adjusting of the switching elements 27 into the respective associated second position 32 in the second switching phase 41 by contrast takes place through a time-interrupted, in the shown example, periodic activation and thus energization of the holding coils 29. The activation and thus energization of the switching coils 30 is, as in FIG. 6, discontinued offset in time according to the desired sequence, but the energization of the energized switching coils 30 is interrupted in the energization phases of the holding coils 29. This means that for those actuators 22, whose switching elements 27 are not to be adjusted into the second position 32 as yet, an energization of the associated switching coil 30 and the holding coils 29 takes place alternately. As soon as none of the coils 29, 30 of the respective actuator 22 is activated or energized, the associated switching element 27 is adjusted into the second position 32. This leads to a reduction of the total energization duration of the switching coils 30 and of the holding coils 29 and thus a reduced load on the coils 29, 30.

Figure 8:
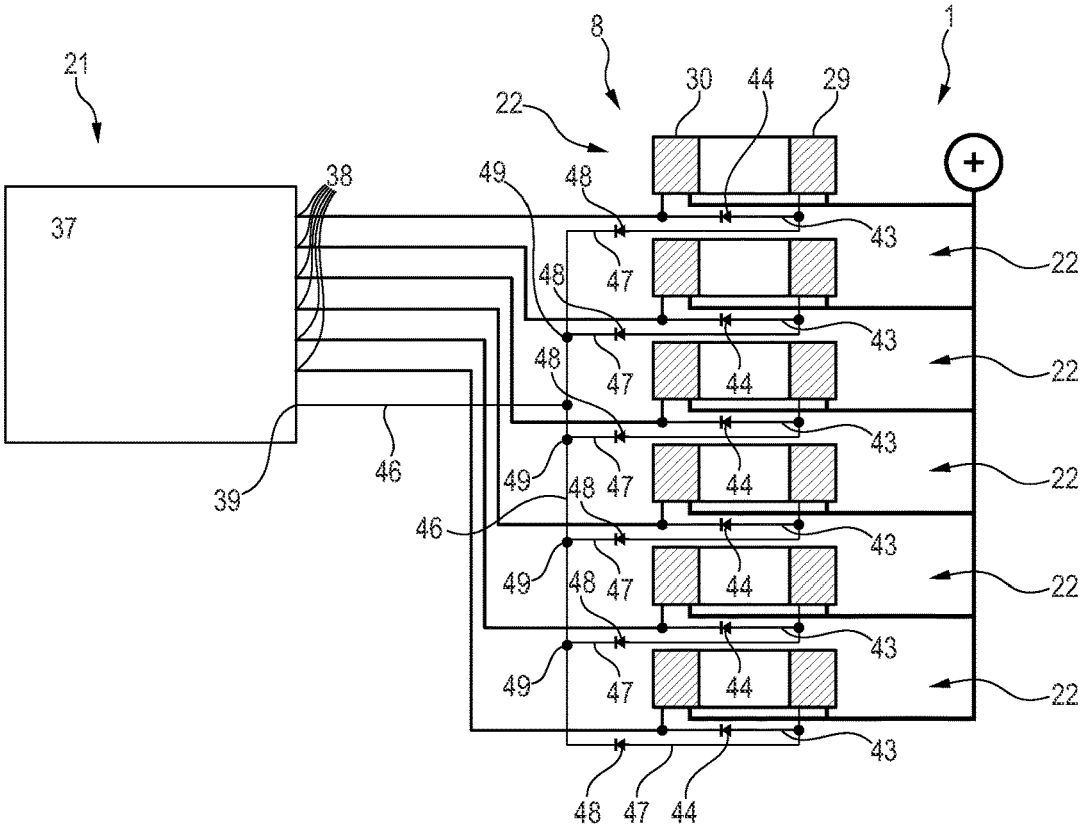
Figure 9:
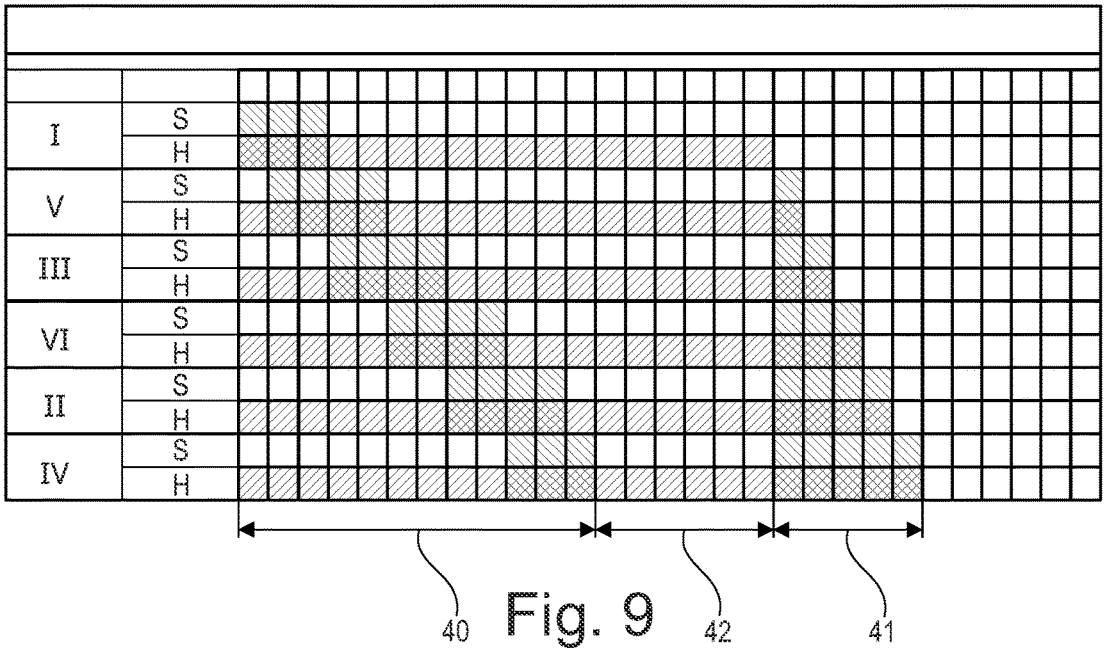

Another exemplary embodiment of the switchover device 21 is shown in FIG. 8. This exemplary embodiment differs from the example shown in FIG. 6 in that for the respective actuator 22 an electrical line 43 is provided, which electrically contacts the switching coil 30 of this actuator 22 with the holding coil 29 of the actuator 22. The line 43 runs outside the coils 29, 30. In the respective line 43 a diode 44 is arranged in such a manner that the diode 44, when the switching coil 30 is energized, allows an energization of the holding coil 29 via the line 43 and blocks a reverse energization, i.e. an energization of the switching coil 30 via the line 43, when the holding coil 29 is energized. In the shown example, the diode 44 allows a technical electrical current flow from the switching coil 30 to that of the associated actuator 22 and blocks the same in the reverse direction. Thus, when the respective switching coil 30 is activated or energized, this results in that the associated holding coil 29 is also activated or energized, so that upon energization of the switching coil 30 the associated holding coil 29 is always energized. Thus, a selective activation or electrification of the respective holding coil 29 takes place via the associated switching coil 30. When the holding coil 29 is already activated and thus energized via the holding coil output 39 of the control unit 37, the control signals and consequently the energizations are thus superimposed. Here, the activation signal of the respective switching coil 30 is dominant vis-à-vis the activation signal of the holding coils 29, so that a continuous energization can be present on the holding coils 29 which, when energizing the respective associated switching coil 30, leads to a cylinder-selective additional energization of the respective holding coil 29. By way of this, the respective holding coil 29 is always employed so as to support the associated switching coil 30. Resulting from this, the switching between the first position 31 and the second position 32 of the associated switching elements 27 can take place faster so that the first switching phase 40 and the second switching phase 41 altogether can be carried out faster. In addition, this leads to a shortened duration of the energization of the coils 29, 30. This is also visible in the switching logics of the switchover device 21 from FIG. 8 shown in FIGS. 9 and 10. There, the switching logic shown in FIG. 9 corresponds to the switching logic shown in FIG. 6, however for the switching device from FIG. 8. It is noticeable that the activation and thus the energization of the respective switching coil 30, symbolised by the letter "S", leads to an additional activation or energization of the associated holding coil 29, symbolised by the letter "H", so that the corresponding fields are shown with a different filling or hatch. This results in that the switching phase 40 in FIG. 9, compared with the switching phase 40 in FIG. 6, is significantly shorter in duration and thus takes place faster.

Figures 10, 11:
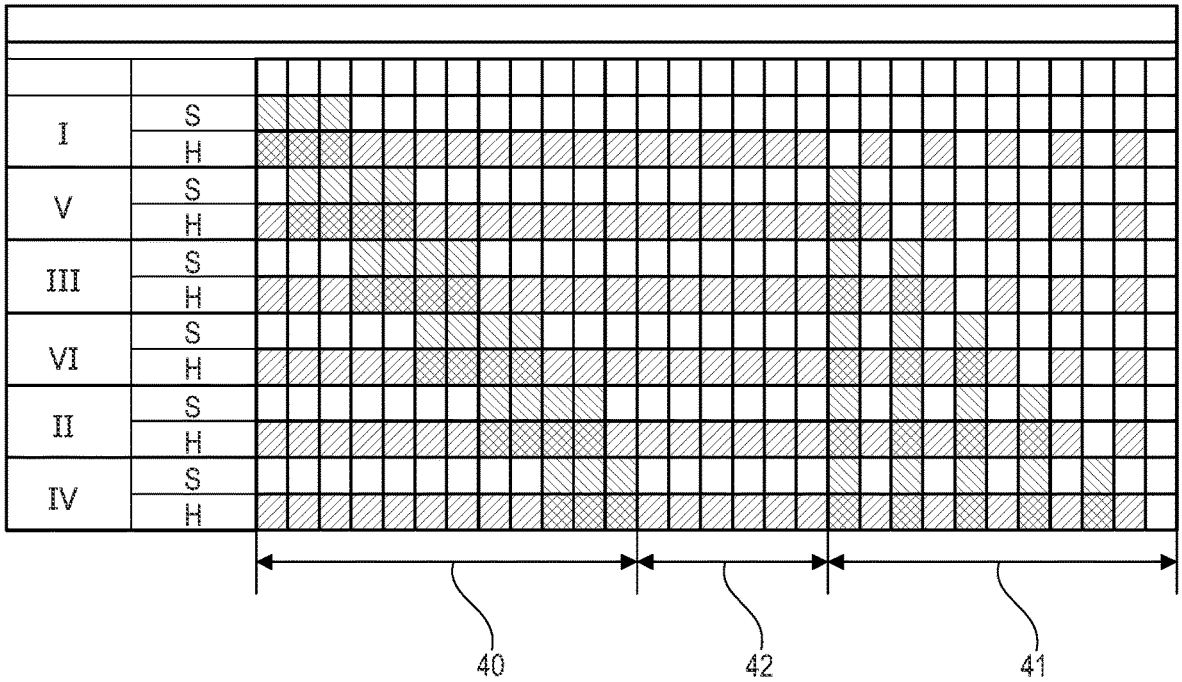

Similar applies to the switching logic shown in FIG. 10, which corresponds to the switching logic shown in FIG. 7, however for the switchover device 21 shown in FIG. 8. Here, too, both the first switching phase 40 and also the second switching phase 41 are shortened. In particular, the respective holding coil 29 is energized via the holding coil output 39 in the second switching phase 41 even when the activation is discontinued, when there is an energization of the associated switching coil 30.

In the example shown in FIG. 8, the holding coils 29 are electrically connected to the main coil output 39 via a common electrical main branch 46. From the main branch 46, an electrical line 47, in the following called sub-branch 47, branches off for the respective holding coil 29 from an associated node 49 and leads to the associated holding coil 29. In the example of FIG. 8, a diode 48, in the following also referred to as sub-branch diode 48, is arranged in the respective sub-branch 47. Upon energization of the holding coil 29, the respective sub-branch diode 48 blocks an energization of the main branch 46 and of the holding coil output 39 via the sub-branch 47. As a consequence, the influence of the respective holding coil 29 on the other holding coils 29 is prevented or at least reduced. In particular it is thus prevented that when a holding coil 29 is energized via the associated switching coil 30, that the other holding coils 29 are also energized.

The respective holding coil 29 is thus energized in the sense of a logical OR-operation, namely when it is energized via the holding coil output 39 or when the associated switching coil 30 is energized. This is explained in FIG. 11 by way of a truth table. The first column of the truth table stands symbolically for the switching coil output 38 of one of the actuators 22, while the second column symbolically stands for the holding coil output 39 of the holding coils 29. The third column stands for the energization state of the switching coil 30 of the actuator 22 and the fourth column for the energization state of the holding coil 29 of the actuator 22. Accordingly, a symbol for the switching coil output 38, right following this a symbol for the switching coil output 39, right following this "S" for switching coil 30 and "H" for holding coil 29 are accordingly entered in the uppermost line. In the following lines, the Figure "0" in the case of the outputs 38, 39 signifies that these are not employed for activation, whereas the Figure "1" signifies that an activation of the associated coil 29, 30 takes place. In the case of the coils 29, 30 "0" means that the coil 29, 30 is not energized, whereas "1" means that the coil 29, 30 is energized. For example, "0" is entered in the second line in all fields. This means that neither the switching coil output 38 activates and thus energizes the associated switching coil 30 nor the holding coil output 39 the holding coils 29. Consequently, neither the switching coil 30 nor the holding coil 29 are energized. When only the holding coils 29 are activated and energized via the holding coil output 39, only the holding coil 29 is energized as is evident from the third line. By contrast, when only an activation takes place via the switching coil output 38, this results in that, as evident from the fourth line, the switching coil 30 and, via the line 43, also the holding coil 29 of this actuator 22 are energized. When, corresponding to the lowermost line, both the switching coil output 38 and also the holding coil output 39 are employed for activation, the switching coil 30 and the main coils 29 are energized.

In the shown figures, all coils 29, 30 are electrically connected to an electrically positive phase. Obviously, an analogous construction can also be realised when all coils 29, 30 are electrically contacted with an electrically negative phase. To this end, the diodes 44, 45 can be arranged in the respective associated line 43, 46 for example in reverse fashion.

The invention claimed is:

1. A valve drive device for actuating valves of an internal combustion engine, comprising:

at least one rocker arm device that interacts with a camshaft, and during operation actuates at least one valve, a switchover device for switching over the at least one rocker arm device between a first position and a second position, the switchover device including at least two actuators for the at least one rocker arm device, wherein the at least two actuators each include:

a switching element for switching over the at least one rocker arm device between the first position and the second position, the switching element being adjustable between a first position and a second position, a resetting device for resetting the switching element with a resetting force into the second position, a holding coil for offsetting the resetting force of the resetting device, a switching coil that counteracts the resetting force during operation, wherein the switching coil and the holding coil during operation adjust the switching element into the first position, wherein the switchover device further includes a control unit for controlling the at least two actuators, the control unit for the respective switching coil of the at least two actuators comprises an associated switching coil output for individually activating the respective switching coils, and wherein the control unit comprises a common main coil output for at least two of the respective holding coils for the joint activation of the respective holding coils.

2. The valve drive device according to claim 1, wherein the resetting device of at least one of the at least two actuators is a spring acting on the switching element.

3. The valve drive device according to claim 1, further comprising:

an electrical line provided for at least one of the at least two actuators that electrically connects the switching coil and the holding coil of the at least one actuator, and wherein a diode is arranged in the electrical line such that the holding coil, when the switching coil is energized, is energized via the electrical line and a reverse energization is blocked.

4. The valve drive device according to claim 1, further comprising:

an electrical sub-branch provided for at least one of the at least two actuators that merges via a node into a main branch that is electrically contacted with the main coil output and electrically connects the holding coil with the holding coil output of the control unit, and wherein a diode is arranged in the electrical sub-branch such that the diode upon energization of the holding coil, blocks an energization of the holding coil output via the electrical sub-branch.

5. The valve drive device according to claim 2, further comprising:

an electrical line provided for at least one of the at least two actuators that electrically connects the switching coil and the holding coil of the at least one actuator, and a diode arranged in the electrical line such that the holding coil, when the switching coil is energized, is energized via the electrical line and a reverse energization is blocked.

6. The valve drive device according to claim 2, further comprising:

an electrical sub-branch provided for at least one of the at least two actuators that merges via a node into a main branch that is electrically contacted with the main coil output and electrically connects the holding coil with the holding coil output of the control unit, and a diode arranged in the electrical sub-branch such that the diode upon energization of the holding coil, blocks an energization of the holding coil output via the electrical sub-branch.

7. The valve drive device according to claim 3, further comprising:

an electrical sub-branch provided for at least one of the at least two actuators that merges via a node into a main branch that is electrically contacted with the main coil output and electrically connects the holding coil with the holding coil output of the control unit, and a diode arranged in the electrical sub-branch such that the diode upon energization of the holding coil, blocks an energization of the holding coil output via the electrical sub-branch.

8. A switchover device of a valve drive device, comprising: at least two actuators for at least one rocker arm device that is switchable between a first position and a second position, the at least two actuators respectively including:

a switching element for switching over the at least one rocker arm device between the first position and the second position, the switching element being adjustable between a first position and a second position, a resetting device for resetting the switching element with a resetting force into the second position, a holding coil for offsetting the resetting force of the resetting device, a switching coil that counteracts the resetting force during operation, wherein the switching coil and the holding coil during operation adjust the switching element into the first position, a control unit for controlling the at least two actuators, the control unit including a switching coil output for the respective switching coils of the at least two actuators for individually activating the respective switching coils, wherein the control unit comprises a common holding coil output for the respective holding coils of the at least two actuators for the joint activation of the respective holding coils.

9. A method for controlling a switchover device according to claim 8, comprising jointly energizing the respective holding coils of the at least two actuators via the common holding coil output of the control unit and the respective switching coils separately via the associated switching coil output of the control unit.

10. The method according to claim 9, further comprising adjusting the respective switching elements sequentially into at least one of the first position and the second position.

11. The method according to claim 10, wherein for sequentially adjusting the respective switching elements into the respective first position:

the respective holding coils are energized via the common holding coil output, and the respective switching coils are energized offset in time according to a desired sequence.

12. The method according to claim 10, wherein for the sequential adjusting of the respective switching elements into the respective second position:

the energization of the respective holding coils via the common holding coil output is discontinued, and the energization of the respective switching coils is discontinued offset in time according to a desired sequence.

13. The method according to claim 10, wherein for the sequential adjusting of the respective switching elements into the respective second position:

the respective holding coils are energized via the holding coil output in time intervals, the energization of the respective switching coils is discontinued offset in time according to a desired sequence, and the energization of the energized switching coils is interrupted in the energization phases of the respective holding coils.

14. The method according to claim 13, wherein the discontinuing of the energization of the respective switching coil takes place in a phase of the respective holding coils that is energization-free via the main coil output.

15. The method according to claim 13, wherein the energization of the respective holding coils via the main coil output takes place at time intervals by a periodical energization.

16. The method according to claim 11, wherein for the sequential adjusting of the respective switching elements into the respective second position:

the energization of the respective holding coils via the common holding coil output is discontinued, and the energization of the respective switching coils is discontinued offset in time according to a desired sequence.

17. The method according to claim 11, wherein for the sequential adjusting of the respective switching elements into the respective second position:

the respective holding coils are energized via the holding coil output in time intervals, the energization of the respective switching coils is discontinued offset in time according to a desired sequence, and the energization of the energized switching coils is interrupted in the energization phases of the respective holding coils.

18. The switchover device according to claim 8, wherein the resetting device of at least one of the at least two actuators is a spring acting on the switching element.

19. The switchover device according to claim 8, further comprising:

an electrical line provided for at least one of the at least two actuators that electrically connects the switching coil and the holding coil of the at least one actuator, and a diode arranged in the electrical line such that the holding coil, when the switching coil is energized, is energized via the electrical line and a reverse energization is blocked.

20. The switchover device according to claim 8, further comprising:

an electrical sub-branch provided for at least one of the at least two actuators that merges via a node into a main branch that is electrically contacted with the main coil output and electrically connects the holding coil with the holding coil output of the control unit, and a diode arranged in the electrical sub-branch such that the diode upon energization of the holding coil, blocks an energization of the holding coil output via the electrical sub-branch.

* * * * *